United States Patent [19]

Nakajima et al.

[11] Patent Number: 4,738,688

[45] Date of Patent: Apr. 19, 1988

[54] PROCESS FOR GASIFYING CARBONACEOUS MATERIAL

[75] Inventors: Hidemasa Nakajima; Shozo Okamura, both of Ibaraki; Masanobu Sueyasu, Kawachinagano; Sakae Furujo, Nara; Shoji Anezaki, Ibaraki, all of Japan

[73] Assignee: Sumitomo Metal Industries, Ltd., Osaka, Japan

[21] Appl. No.: 886,360

[22] Filed: Jul. 17, 1986

Related U.S. Application Data

[62] Division of Ser. No. 647,741, Sep. 6, 1984, abandoned.

[30] Foreign Application Priority Data

Sep. 7, 1983 [JP] Japan ..... 58-165787

[51] Int. Cl.[4] ..... C10J 3/48

[52] U.S. Cl. ..... 48/197 R; 45/92; 45/210

[58] Field of Search ..... 239/422, 424.5; 266/225, 160; 48/92, 197 R, 210

[56] References Cited

U.S. PATENT DOCUMENTS 3,911,716 11/1968 Stephan et al. ..... 239/132.3
4,388,084 6/1983 Okane et al. ..... 48/210
4,432,539 2/1984 Zanetta et al. ..... 266/225

FOREIGN PATENT DOCUMENTS 2043677 10/1980 United Kingdom .

OTHER PUBLICATIONS

Berkowitz, Coal Gasification, A "State-of-the Art" Review, Apr. 1973, p. 32.

*Primary Examiner*—Peter Kratz
*Attorney, Agent, or Firm*—Burns, Doane, Swecker & Mathis

[57] ABSTRACT

A process including an apparatus for use therein for gasifying a carbonaceous material by means of blowing said carbonaceous material onto a high temperature molten iron bath through a top-blowing lance of the non-immersion type is disclosed. The apparatus comprises a furnace body containing the high temperature molten iron bath, a top-blowing lance of the non-immersion type which is a multi-nozzle lance comprising a central nozzle for blowing the carbonaceous material in a powdery form, a plurality of inner nozzles for blowing a gasifying agent, the inner nozzles for blowing the gasifying agent being positioned surrounding said central nozzle, and another plurality of outer nozzles for blowing an oxidizing gas for secondary combustion of part of the product gas to maintain the molten iron bath temperature at a level high enough to continue the gasification, said outer nozzles being positioned surrounding said plurality of inner nozzles, the axis of each of said outer nozzles being inclined towards the outer periphery at an angle of 20°-60° with respect to the axis of said central nozzle, means for discharging the slag during gasification, and means for recovering the product gas.

7 Claims, 4 Drawing Sheets

PROCESS FOR GASIFYING CARBONACEOUS MATERIAL

This application is a division of application Ser. No. 647,741, filed Sept. 6, 1984, now abandoned.

BACKGROUND OF THE INVENTION

This invention relates to an improved method of gasifying carbonaceous material such as coal, coke, pitch, and the like (hereunder collectively referred to as "carbonaceous material") by blowing the carbonaceous material together with a gasifying agent such as oxygen onto a molten iron bath at high temperatures.

It is known in the art that a carbonaceous material is injected into a molten iron bath together with a gasifying agent to carry out gasification of the carbonaceous material. This process is called "molten iron coal gasification process". This process is classified into two types: one is a top-blowing process in which carbonaceous material is blown simultaneously with a gasifying agent onto a molten iron bath from the above through one or more top-blowing lances (See U.S. Pat. Nos. 4,388,084 and 4,389,246); the other one is a bottom-blowing process in which the carbonaceous material is blown simultaneously with a gasifying agent onto the molten iron bath from a tuyere provided under the surface of the molten metal bath (See U.S. Pat. Nos. 3,533,739 and 3,526,478). It has been thought that the top-blowing process is more advantageous than the bottom blowing process in its gasification efficiency, properties of the produced gas and operational stability.

Namely, so long as the top-blowing process is concerned, there is no leakage of molten iron from the tuyeres and the blowing can be stopped immediately without having to worry about the clogging of the tuyeres, even when a trouble occurs in the blowing system. In contrast, in the case of the bottom-blowing process the tuyeres would easily be clogged if the blowing was stopped when an accident occurred in the blowing system.

The top-blowing process is also superior to the bottom-blowing process in its gasification efficiency, i.e. the amount of carbonaceous material gasified per unit treating time, since the bottom blowing process has an inherent upper limit in the blowing rate of a carrier gas for carbonaceous material. The upper limit is determined on the depth of a molten iron bath employed. If the blowing rate increases above the upper limit, unreacted coal is blown off through the molten iron bath, markedly decreasing the efficiency of gasification. On the other hand, a lower limit also exists to prevent the clogging of tuyeres. Thus, the blowing rate of a carrier gas of the bottom blowing process is restricted to within a relatively small range.

In contrast, according to the top-blowing process, the process is free from the clogging of the tuyeres or the passing through of the carbonaceous material. The top-blowing process is not limited, in practice, in respect to the blowing rate of carbonaceous material, either. Thus, according to the top-blowing process, the volume of the gas produced per unit treating time is very large and it is easy to control the volume, i.e. productivity.

However, the top-blowing process has a lot of heat balance problems common to all other coal gasification processes with a molten iron bath, although they have many advantages such as in the above.

Namely, according to the top-blowing process the carbonaceous material is decomposed at fire points the temperatures of which are much higher than that required to decompose it inother processes. Thus, the resulting gas of this top-blowing process is rich in CO and $H_2$, and the proportion of $CO_2$ is rather small. This means that such a gas composition as in the above is satisfactory to be utilized as a fuel gas and as a chemical raw material. But, this also means that the carbon added is converted into CO gas, not to $CO_2$ gas. The conversion into $CO_2$ gas generates heat enough to promote gasification. In the case of the gasification of coal containing a large amount of ash, moisture and volatile matters, the thermal balance of the top blowing gasification process shifts itself to an endothermic one, making continuation of the process quite difficult. In order to cope with these problems, there has been proposed the following two methods:

One method is to combine a highly exothermic, high grade coal with the above low grade coal to provide a mixture containing less ash, moisture and volatiles. The thus combined mixture of coal is then subjected to gasification. However it is quite expensive to keep a constant mixing ratio, and to keep the coal composition constant throughout the process. Even the mere employment of pulverization and mixing adds to the manufacturing cost significantly.

It is generally said that a coal gasification plant should be built in an area where coal is mined so as to reduce the gasification costs. However, it is low grade coal which is highly demanded today for being treated through gasification processes in order to increase the utility value of the products. Since this type of material is less expensive, a commercial gasification plant is feasible. However, in practice, stable operation cannot be achieved on a commercial basis, because it is quite rare that high grade coal and low grade coal are found at the same mining site. For the above reasons, it is impractical to balance the thermal conditions by means of combining a less exothermic, low grade coal with a highly exothermic, high grade coal.

The other method is the one called the "soft blowing" method, in which a secondary combustion is carried out by means of increasing the height of the lance, i.e. the distance between the nozzle end of the lance and the surface of the molten iron bath.

Namely, the carbonaceous material is injected through the lance to reach the molten iron bath surface and then goes into the melt. Since according to this secondary combustion method, the height of the lance is increased, the distance between the lance tip and the molten iron bath surface is also increased, and the time the carbonaceous material takes to go from the lance to the molten metal surface is also increased. This means that before the carbonaceous material reaches the surface of the molten metal bath, it reacts with a gasifying agent such as oxygen and the amount of sulfur which is carried in the combustion gas is markedly increased in comparison with the amount of sulfur which is caught by the slag placed on the molten metal bath. This results in an increase in the sulfur content of the product gas. A desulfurization apparatus has to be installed to treat the product gas to decrease the sulfur content to a feasible level. This also adds to the manufacturing costs of the product gas.

SUMMARY OF THE INVENTION

The object of this invention is to provide an apparatus for gasifying carbonaceous material by means of the top-blowing process, in which the thermal balance within the furnace of gasification has been improved most efficiently and conveniently.

This invention resides in an apparatus for gasifying a carbonacenous material by means of blowing said carbonaceous material onto a high temperature molten iron bath through a top-blowing lance of the non-immersion type, which comprises:

a furnace body containing the high temperature molten iron bath;

a multi-nozzle, top-blowing lance of the non-immersion type comprising a central nozzle for blowing the carbonaceous material in a powdery form, a plurality of inner nozzles for blowing a gasifying agent, the inner nozzles for blowing the gasifying agent being positioned surrounding said central nozzle, and another plurality of outer nozzles for blowing an oxidizing gas for secondary combustion of part of the product gas to maintain the molten iron bath temperature to a level high enough to continue the gasification, said outer nozzles being positioned surrounding said plurality of inner nozzles, the axis of each of said outer nozzles being inclined towards the outer periphery at an angle of 20°-60° with respect to the axis of said central nozzle;

means for discharging the slag formed during gasification; and means for recovering the product gas.

In one embodiment of this invention, the gasification furnace may be of the multi-lance type in which at least one of the lances has the structure defined in the above.

BRIEF DESCRIPTION OF THE DRAWINGS

FIG. 2(*c*) is an end view of the top-blowing lance employed in this invention;

DETAILED DESCRIPTION OF THE PREFERRED EMBODIMENTS

Figure 1:
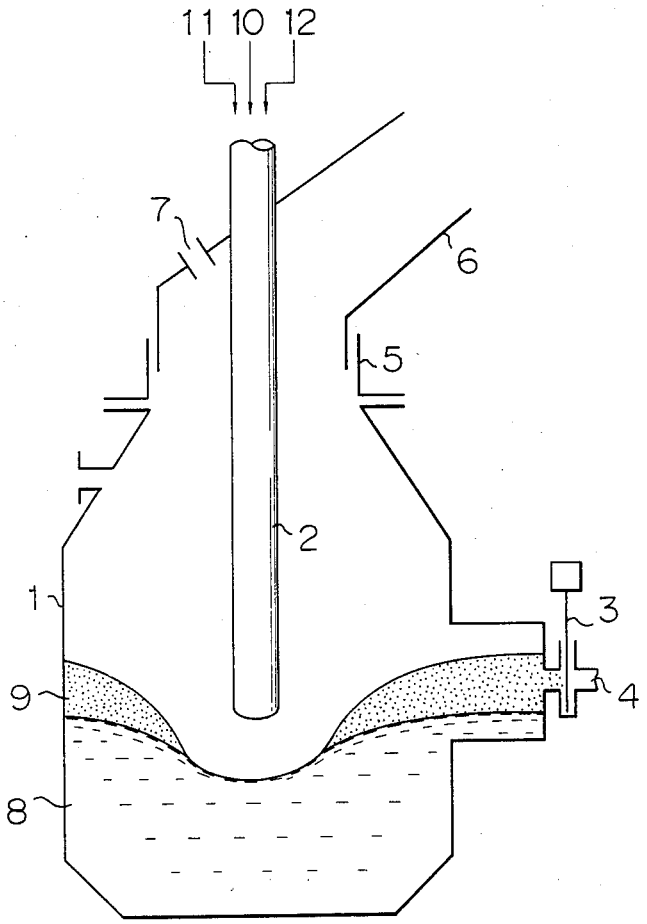
FIG. 1 is a schematic illustration of the gasification furnace employed in this invention.

FIG. 1 is a schematic illustration of a melting furnace, i.e. gasification furnace which contains a molten metal 8. The gasification furnace comprises a furnace body 1, a slag discharge port 4 provided in the side wall portion for discharging slag 9 through a sliding gate 3. Around the top opening of the furnace a skirt portion 5 and a hood 6 are provided for recovering the product gas, which is formed within the furnace. An inlet 7 for charging additives is provided on the hood.

Figure 2A:
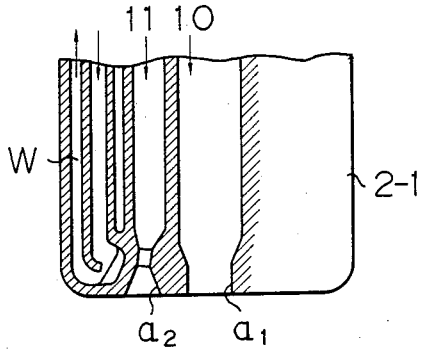
FIG. 2(*a*) and FIG. 2(*b*) are sectional views taken along I—I and II—II lines of FIG. 2(*c*), respectively.
Figure 2B:
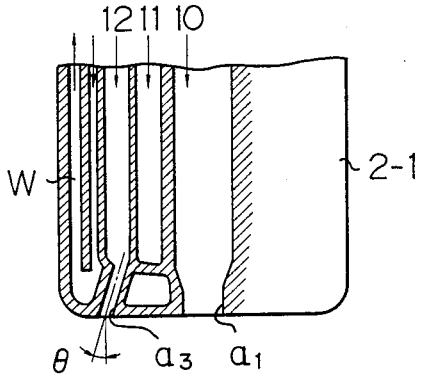
Figure 2C:
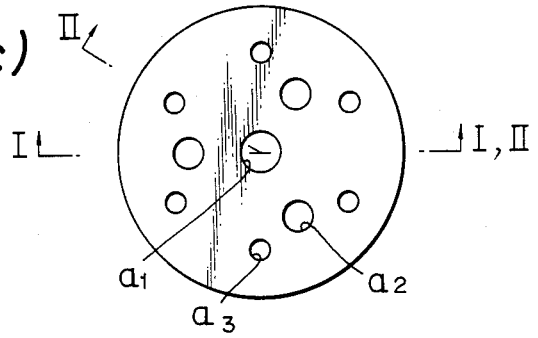

The structure of the top-blowing lance 2 of the non-immersion type is detailed in FIG. 2(*a*) through FIG. 2(*c*). FIG. 2(*a*) is a sectional view taken along line I—I of FIG. 2(*c*) and FIG. 2(*b*) is a sectional view taken along line II—II of FIG. 2(*c*).

The lance body 2-1 comprises a powder blowing nozzle $a_1$ in the center thereof. Through this center blowing nozzle the carbonaceous material in the form of powder and a carrier gas therefor are injected into the molten iron 8.

A plurality of nozzles $a_2$ for blowing a gasifying agent are provided surrounding said powder blowing nozzle $a_1$. Preferably, they are on a circle concentric with the central nozzle $a_1$. Another plurality of nozzles $a_3$ are provided along an outer periphery, surrounding said plurality of nozzles $a_2$. In the preferred embodiment shown in FIGS. 2, the outer nozzle $a_3$ are also on a circle which is concentric not only with the central nozzle $a_1$ but also with the circle drawn through said inner nozzles $a_2$. In FIG. 2(*c*), the six outer nozzles $a_3$ are arranged concentrically with respect to a circle drawn through three inner nozzles $a_2$, surrounding the circumference thereof. In the preferred embodiment shown in the drawings, as is apparent from FIG. 2(*c*), all the nozzles $a_1$, $a_2$, and $a_3$ are round in section. The number of the outer nozzles $a_3$ is preferably more than that of the inner nozzles $a_2$.

Furthermore, the axis of each of the outer nozzles $a_3$ is inclined towards the outer periphery at an angle of 20°-60°, preferably 20°-40° with respect to the axis of the central powder blowing nozzle $a_1$. The angle is shown in FIG. 2(*b*) by the symbol "$\theta$".

Reference W shows a passageway for a coolant.

Thus, according to one aspect of this invention, each of nozzles $a_3$ for blowing a secondary combustion gas is provided being inclined towards the outer periphery at an angle of 20°-60° with respect to an axis parallel to the axis of the central nozzle $a_1$. When the angle $\theta$ is smaller than 20°, the gas blown through these nozzles $a_3$ is not effective for establishing a advantageous secondary combustion. On the other hand, when the angle is larger than 60°, the gas blown therethrough is enough to establish the secondary combustion, but the resulting flames cannot reach the molten iron surface so that the heat contained in the flames cannot arrive into the molten iron bath. In addition, since the flames are diverged so widely that they cause severe damage to the wall of the furnace.

The top-blowing lance 2 having the above-described structure is inserted into the furnace 1 such that the tip of the lance is positioned a predetermined distance from the surface of the molten iron 8. Then a powdered carbonaceous material 10 carried in a carrier gas such as air, nitrogen and the like is injected into a molten iron bath through the central powder blowing nozzle $a_1$. The gasifying agent 11 is blown through the gasifying agent nozzles $a_2$ and oxygen gas is blown through the secondary combustion gas nozzles $a_3$.

According to this invention, the oxygen for the secondary combustion is blown into the furnace independently from the blowing of a gasifying agent, i.e. blown through different nozzles. The gasifying agent may also be oxygen.

Therefore, though the height of a lance is substantially the same as conventionally, the secondary combustion of the product gas takes place efficiently. There is no need to carry out the so-called soft-blowing by lifting up the lance, so that the blown carbonaceous material does not burn before it is injected into the molten iron bath. On the contrary, a large amount of heat generated through the secondary combustion may advantageously be transmitted to the molten iron bath, so that the temperature of the molten iron bath is maintained at a level high enough to continue the gasification.

As already described, the carbonaceous material is injected together with a carrier gas through the central powder blowing nozzle $a_1$ into the molten iron bath at fire points which are formed thanks to an oxygen jet simultaneously injected through the gasifying agent blowing nozzles $a_2$, and the thus injected carbonaceous material is subjected to rapid dissolution and thermal decomposition at the fire points and then CO-gas forming reactions take place vigorously. The reaction gas generated within the furnace, other than the part which should be consumed in the secondary combustion, is recovered from the top opening by way of the skirt portion 5 and the hood 6.

The slag 9 formed during gasification is discharged out of the slag discharge port 4. The amount of slag to be discharged may be controlled by means of the sliding gate 3. In order to adjust basicity of the slag 9, a suitable flux such as calcium oxide (quicklime, for example) may be added in the form of powder in the mixture with the carbonaceous material by way of the nozzle $a_1$ or in the form of bulk by way of an auxilliary raw material inlet 7 provided in the product gas recovering hood 6.

According to this invention, since oxygen gas may be blown into the furnace in order to promote the secondary combustion of the product gas by way of a passageway different from the passage for the gasifying agent, less exothermic (or endothermic), carbonaceous material such as brown coal can efficiently be subjected to a continued gasification. According to this invention, there is no need to combine a highly exothermic, carbonaceous material, nor to carry out the so-called soft blowing by lifting the top-blowing lance. Nevertheless, according to this invention the heat generated by the secondary combustion is efficiently transmitted into the molten iron bath while suppressing a decrease in the calorific value of the product gas to the smallest possible extent.

Thus, according to this invention the most advantageous thermal balance can be achieved within a gasification furnace even in cases where a low grade coal, such as brown coal is charged.

This invention will be described in conjunction with a working example, which is presented as a specific illustration of this invention. It should be understood, therefore, that this invention is not limited to the specific details set forth in the example.

EXAMPLE

A melting furnace shown in FIG. 1 with a capacity of 10 tons was used to carry out gasification of this invention. The furnace held molten iron having the chemical composition shown in Table 1 at 1510° C. The top-blowing lance employed was of the type shown in FIGS. 2 with dimensions:

| | |
|---|---|
| Nozzle $a_1$: | diameter of 16 mm. |
| Inner Nozzles $a_2$: (Laval-type) | throat portion diameter of 12 mm |
| Outer Nozzles $a_3$: (Straight-type) | inner diameter of 6 mm and inclination angle ($\theta$) of 30°. |

A coal powder having a chemical composition shown in Table 2 (more than 80% −200 mesh) was injected into the molten iron bath through the nozzle $a_1$ at a rate of about 3000 kg/Hr on average, oxygen gas as a gasifying agent was blown through inner nozzles $a_2$ at a rate of about 850 $Nm^3$/Hr. Oxygen gas as an oxidizing gas for the secondary combustion was blown into the furnace through outer nozzles $a_3$ at a rate of about 180 $Nm^3$/Hr. A suitable amount of a flux was also added so as to adjust basicity of the slag to be about 1.8–2.2. A carrier gas for the powdered coal was nitrogen.

The distance between the lance tip and the molten iron bath surface was one meter.

Figure 3A:
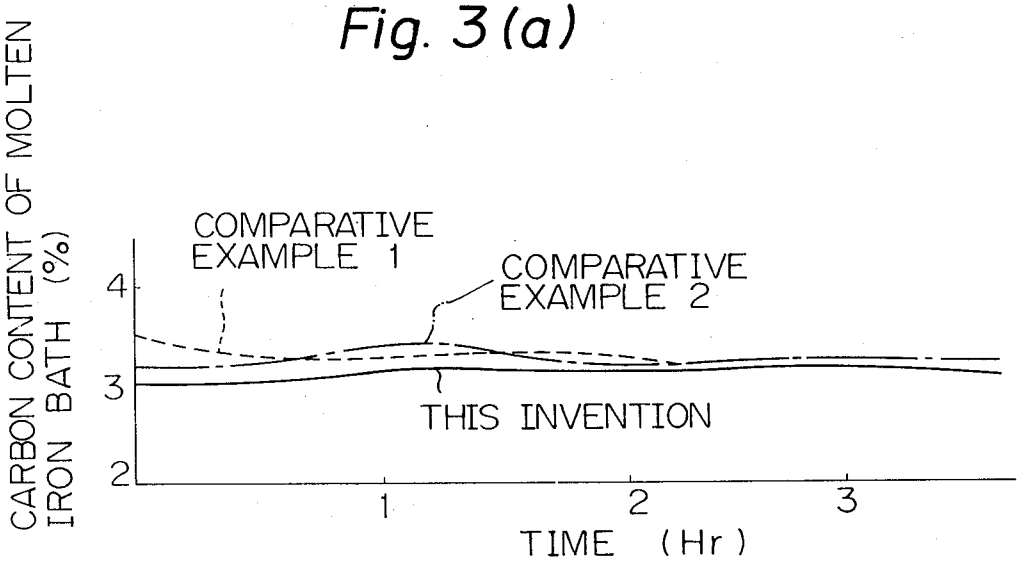
FIG. 3(*a*) and FIG. 3(*b*) are graphs showing experimental data obtained in the working example of this invention in comparison with those of the comparative examples.
Figure 3B:
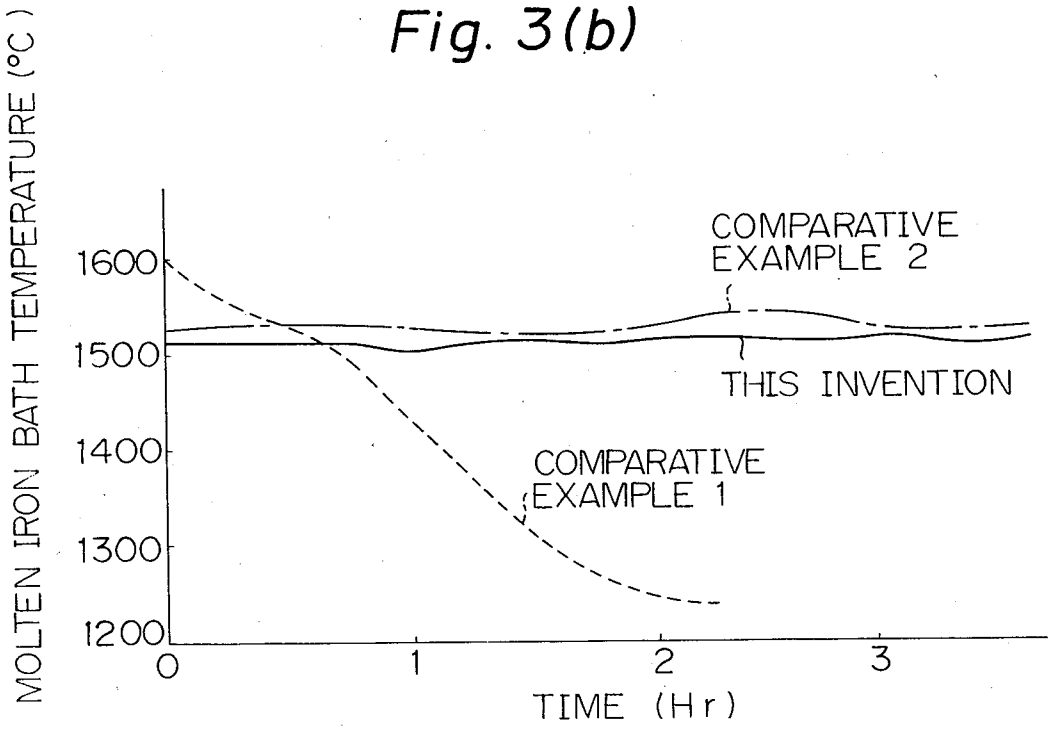

The gasification was continued for 4 hours. The average gas composition of the product gas is summarized in Table 3 and changes in carbon content of the molten iron bath and in temperature of the molten iron bath during gasification are shown by graphs in FIG. 3(*a*) and FIG. 3(*b*), respectively.

COMPARATIVE EXAMPLE 1

The Example shown in the above was repeated using a molten metal bath at 1600° C. except that the top-blowing lance employed herein does not have the outer nozzles $a_3$ for blowing oxygen gas for the secondary combustion of the product gas, and that oxygen gas as a gasifying agent was blown into the furnace at a rate of 950 $Nm^3$/Hr.

COMPARATIVE EXAMPLE 2

In this example, Comparative Example 1 was repeated using a molten metal bath at 1525° C. except that oxygen gas as a gasifying agent was blown at a rate of 1070 $Nm^3$/Hr.

In this comparative example, the distance between the tip of the lance and the molten iron surface was adjusted to be 2 meters to achieve the so-called soft-blowing. This has been thought to be effective for promoting the secondary combustion and preventing the molten iron bath temperature from lowering.

Average gas composition of the product gases and changes in carbon content and bath temperatures of Comparative Examples 1 and 2 are summarized in Table 3, in comparison with those data of the working Example of this invention.

As is apparent from Table 3, so long as the conventional top-blowing gasification such as that shown in Comparative Example 1 is concerned, it is extremely difficult to continue gasification of such a low grade coal as shown in Table 2 without a decrease in the carbon content of the molten iron bath or without resulting in solidification of the molten iron bath.

From Comparative Example 2, it is noted that by increasing the distance between the lance tip and the molten iron surface it is possible to maintain the carbon content of the molten iron bath and the temperature thereof during gasification. However, as shown in Table 3, it is unavoidable that the proportions of Co gas and $H_2$ gas decrease, but that of $CO_2$ gas increases. In addition, the amount of contaminants such as $H_2S$, COS, etc. increases. Thus, the so-called soft blowing is undesirable from the practical point of view.

In contrast, according to this invention, the deterioration in gas composition is kept to minimum levels, and it is possible to carry out gasification of the less exothermic type coals, such as brown coal.

TABLE 1

| | | Molten Metal Bath | | | | | |
|---|---|---|---|---|---|---|---|
| | | Chemical Composition (% by wt) | | | | | Temperature |
| | | C | Si | Mn | P | S | (°C.) |
| Invention | | 3.02 | 0.01 | 0.18 | 0.098 | 0.012 | 1510 |
| Compar- | (1) | 3.51 | 0.02 | 0.19 | 0.105 | 0.011 | 1600 |
| ative | (1) | 3.18 | 0.01 | 0.20 | 0.095 | 0.014 | 1525 |

TABLE 2

| Proximate Analysis (% by wt) | | | | Elemental Analysis (d.a.f. base % by wt) | | | |
|---|---|---|---|---|---|---|---|
| $C_{fix}$ | V.M. | Ash | Moisture | C | H | O | S |
| 35.8 | 45.5 | 12.2 | 6.5 | 60.3 | 4.9 | 27.2 | 6.1 |

Note:
d.a.f.(dry ash free)

TABLE 3

| | | Major Gaseous Components (% by vol) | | | Contaminants (ppm) | | |
|---|---|---|---|---|---|---|---|
| | | CO | $CO_2$ | $H_2$ | COS | $H_2S$ | T.S |
| Invention | | 55.5 | 6.9 | 32.0 | 28 | 55 | 83 |
| Compar- | (1) | 57.0 | 4.5 | 33.0 | 95 | 210 | 305 |
| ative | (2) | 54.7 | 8.0 | 31.6 | 570 | 1100 | 1670 |

What is claimed is:

1. A process for gasifying carbonaceous material be means of blowing said carbonaceous material into a high temperature molten iron bath through a top-blowing lance of the non-immersion type, which comprises:

preparing a high temperature molten iron bath contained in a furnace body;

providing a multi-nozzle, top-blowing lance of the non-immersion type, which is inserted into the furnace through an opening in the top thereof, and which comprises a central nozzle, a plurality of inner nozzles of the Laval type positioned surrounding said central nozzle, and another plurality of outer nozzles of the straight type positioned surrounding said plurality of inner nozzles, the central axis of each of said outer nozzles being inclined divergently outward at an angle of 20°–60° with respect to the axis of said central nozzle;

blowing the carbonaceous material in a powdery form through said central nozzle;

blowing a gasifying agent through said inner nozzles;

blowing an oxidizing gas for secondary combustion of part of the product gas through said outer nozzles to maintain the molten iron bath temperature at a level high enough to continue the gasification; and blowing the oxidizing gas for secondary combustion into the furnace independently of the gasifying agent.

2. The process of gasifying a carbonaceous material as defined in claim 1, in which the axis of each of said outer nozzles is inclined towards the outer periphery at an angle of 20°–40° with respect to the axis of said central nozzle.

3. The process for gasifying a carbonaceous material as defined in claim 2, in which the number of the outer nozzles in more than that of the inner nozzles.

4. The process for gasifying a carbonaceous material as defined in claim 1, in which said outer nozzles are positioned surrounding an outer periphery of a circle drawn through said plurality of inner nozzles.

5. The process of gasifying a carbonaceous material as defined in claim 1, in which said outer nozzles are on a circle concentric with the circle drawn through said inner nozzles.

6. The process of gasifying a carbonaceous material as defined in claim 5, in which said outer nozzles are positioned substantially at an equal interval.

7. A process for minimizing the amount of sulfur-containing contaminants contained in the product gas of a carbonaceous material gasification process, which comprises:

preparing a high temperature molten iron bath contained in a furnace body;

providing a multi-nozzle, top-blowing lance of the non-immersion type, which is inserted into the furnace through an opening in the top thereof, and which comprises a central nozzle, a plurality of inner nozzles of the Laval type positioned surrounding said central nozzle, and another plurality of outer nozzles of the straight type positioned surrounding said plurality of inner nozzles, the central axis of each of said outer nozzles being inclined divergently outward at an angle of 20°–60° with respect to the axis of said central nozzle;

blowing the carbonaceous material in a powdery form through said central nozzle;

blowing a gasifying agent through said inner nozzles; and blowing an oxidizing gas for secondary combustion of part of the product gas through said outer nozzles independently of said gasifying agent to maintain the molten iron bath temperature at a level high enough to continue the gasification, and to eliminate sulfur-containing compounds from the product gas.

* * * * *